United States Patent [19]

Hoover et al.

[11] Patent Number: 4,961,693

[45] Date of Patent: Oct. 9, 1990

[54] FUEL PUMP ISOLATION MOUNT

[75] Inventors: Thomas M. Hoover, Reese; Edward J. Talaski, Caro, both of Mich.

[73] Assignee: Walbro Corporation, Cass City, Mich.

[21] Appl. No.: 284,996

[22] Filed: Dec. 16, 1988

[51] Int. Cl.[5] ..... F04B 35/04

[52] U.S. Cl. ..... 417/363; 417/423.15

[58] Field of Search ..... 417/360, 363, 371, 410, 417/423.3, 423.14, 423.15, 424.1; 222/385; 248/611, 613, 618, 218.4

[56] References Cited

U.S. PATENT DOCUMENTS

| | | | |
|---|---|---|---|
| 1,536,407 | 5/1925 | Pettus | 248/611 |
| 3,145,910 | 8/1964 | Jolly | 417/363 |
| 3,243,154 | 3/1966 | Dryden | 248/611 |
| 3,538,357 | 11/1970 | Barthalon | 310/16 |
| 3,659,963 | 5/1972 | Ebert et al. | 417/363 |
| 4,174,189 | 11/1979 | Elson | 417/363 |
| 4,569,637 | 2/1986 | Tuckey | 417/363 |
| 4,590,964 | 5/1986 | Beardmore | 417/363 |
| 4,591,319 | 5/1986 | Takahaski et al. | 417/360 |
| 4,697,995 | 10/1987 | Tuckey | 418/15 |
| 4,768,925 | 9/1988 | Geupel | 417/363 |
| 4,820,139 | 4/1989 | Tuckey | 417/360 |

FOREIGN PATENT DOCUMENTS

| | | | |
|---|---|---|---|
| 1550327 | 9/1969 | Fed. Rep. of Germany | 251/303 |

*Primary Examiner*—Leonard E. Smith
*Assistant Examiner*—Robert N. Blackmon
*Attorney, Agent, or Firm*—Barnes, Kisselle, Raisch, Choate, Whittemore & Hulbert

[57] ABSTRACT

A mounting for an electric fuel pump in a fuel tank of a passenger vehicle which includes an oversize, open-ended enclosure to surround a pump within the fuel tank. The enclosure is mounted on a pipe depending into the fuel tank from a cantilever connection. The pump is floatingly mounted in the enclosure by conical coil springs at each end seated respectively on the pump housing and inner flanges of the enclosure. The enclosure is formed of two telescoping portions clamped together by a plate which also traps the depending pipe to support the assembly within the fuel tank.

5 Claims, 1 Drawing Sheet

FIG.1
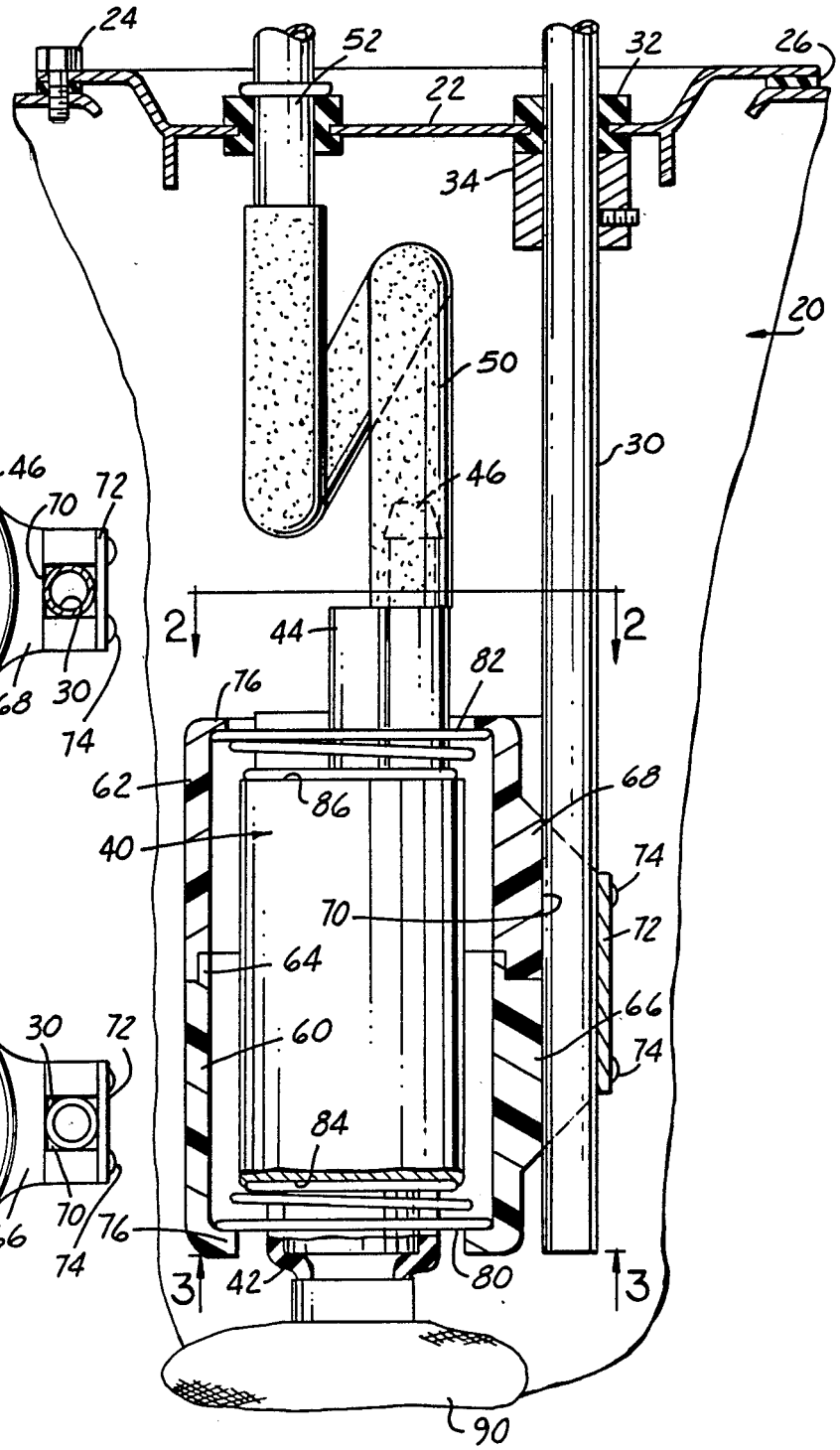
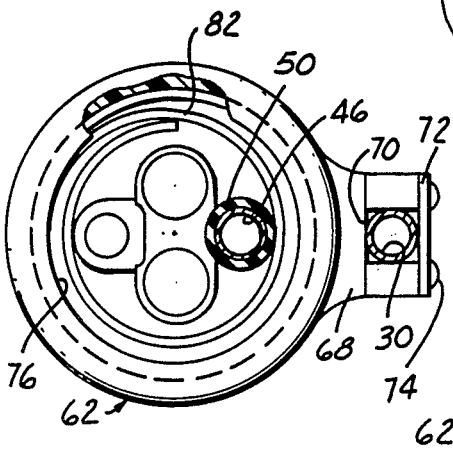
FIG.2
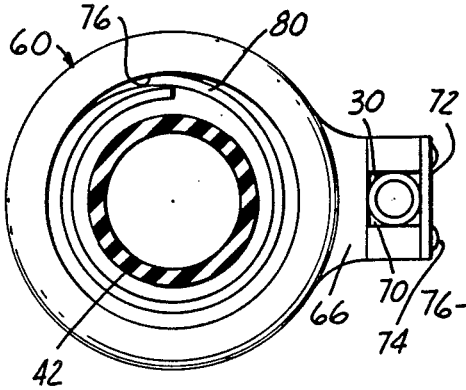
FIG.3

FUEL PUMP ISOLATION MOUNT

FIELD OF THE INVENTION

Mounting of electric fuel pumps in vehicle fuel tanks to reduce noise and vibration transmitted to the vehicle passenger compartment.

BACKGROUND AND FEATURES OF THE INVENTION

With the advent of fuel injection for internal combustion engines, it has become common to mount electrically operated fuel pumps in the fuel tank of a vehicle. These pumps, though quite small, rotate at high rates of speed. Any unbalance in the pump, or a condition called cavitation, or pulsations of the pumping element, can cause noise and vibration of the pump housing. Since the fuel tank is usually mounted at the area of a passenger compartment of a vehicle, this noise or vibration can be a source of discomfort or irritation to passengers.

It is, therefore, desirable to mount the pump in a way which will reduce the transmission of noise and vibration to a minimum and render it generally imperceptible to passengers. The pump design is involved in this reduction but also the mounting of the pump.

U.S. Pat. Nos. 4,590,964 (Beardmore) and 4,591,319 (Takahashi et al) are directed to this problem of noise and vibration in the use of rubber mounting elements. U.S. Pat. No. 3,659,965 (Ebert et al) shows a combination of an elastomeric housing over a coil spring. Leaf spring mounts for motors are illustrated in U.S. Pat. No. 3,145,910 (Jolly) and 3,538,357 (Barthalon). U. S. Pat. No. 4,569,637 (Tuckey) shows a metallic outer shell with rubber end mounts.

The present invention is directed to a mounting system for a fuel pump designed to reduce noise and vibration in a relatively simple structure which avoids the use of any rubber or elastomeric material, the latter being subject to deterioration with continued exposure to hydrocarbon fuels. In addition, the elastomeric material spring rate also changes with temperature.

Briefly, the invention achieves the desired objects by utilizing a molded casing dimensioned oversize relative to the pump housing and formed to mount on a depending pipe provided in the fuel tank for return fuel flow from the basic pumping system. Two coil springs of very low natural frequency with axially diminishing diameters are provided at each end of the pump housing to mount the housing in the casing for resilient motion axially and radially. A flexible outlet conduit from the pump conducts fuel through the top of the tank to a fuel supply conduit leading to a vehicle engine.

Other objects and features of the invention will be apparent in the following description and claims in which the principles of the invention are set forth together with details to enable persons skilled in the art to practice the invention all in connection with the best mode presently contemplated for the invention.

BRIEF DESCRIPTION OF THE DRAWINGS

DRAWINGS accompany the disclosure and the various views thereof may be briefly described as:

FIG. 1, an assembly view in section showing the elements of the pump mount.

FIG. 2, a sectional view on line 2—2 of FIG. 1.

FIG. 3, a sectional end view on line 3—3 of FIG. 1.

DETAILED DESCRIPTION OF THE INVENTION AND THE MANNER AND PROCESS OF USING IT

In fuel systems for internal combustion engines used in vehicles, it is currently a practice to mount an electrically powered fuel pump within a fuel tank remote from the engine. The pump delivers fuel under pressure to an engine manifold which in many cases carries fuel injection devices to deliver fuel to the respective cylinders of the engine. A pressure regulator valve controls the pressure of the fuel delivery and by-passes excess fuel back to the main fuel tank. In the present structure, the by-pass fuel enters the tank through a rigid depending tube having a cantilever mount in the top of the tank.

With reference to the drawings, a conventional fuel tank 20 has a closure cap 22 which can be attached by cap screws 24 or by a screw-on thread in a conventional manner. A sealing ring 26 is preferred. A rigid fuel return pipe 30 has a cantilever mount in cap 22 through a flexible grommet 32 and an adjustable locator sleeve 34. This pipe depends into the tank to a position adjacent the bottom.

A pump housing 40 is in the form of a cylindrical shell for an electrically driven pump similar to that disclosed and illustrated in U.S. Pat. No. 4,697,995 (Tuckey), dated Oct. 6, 1987. The pump 40 has an inlet 42 adjacent the bottom of the tank 20 and a top outlet tower 44 from which projects connection nipple 46. A flexible tube 50 connects the pump outlet with fuel line connector 52 mounted also in closure cap 22. This tube isolates the pump so vibration does not transmit to the closure cap and tank.

A two-part molded housing formed preferably of a high impact plastic consist of a bottom element 60 and a top element 62 joined in a telescoping snug fit 64. Each element has a side extension 66 and 68, respectively, in an axial abutting relationship. Aligned open side grooves 70 in these extensions surround the return pipe 30. A plate 72 is clamped over the side grooves 70 by headed screws 74. The grooves are dimensioned such that tightening the plate 72 against the housing elements clamps the elements 60 and 62 on to the return pipe 30. The housing elements are open at the respective ends of the pump, the openings being flanged inwardly at 76 to leave a circular opening equal to or somewhat larger than the diameter of the pump housing 40.

The overall axial inside dimension of the elements 60, 62 is longer than the basic pump housing 40. Coil springs 80 and 82 having a very low natural frequency are formed to have an outer coil diameter to seat on the respective flanges 76 and the springs enamel in diameter to an inner coil which seats on shoulders 84, 86 at the respective ends of the pump housing 40. The coils of the springs are preferably spaced axially to allow axial movement of the pump housing without coil contact. In addition the coils will have a side flexibility so that the pump housing is essentially floating in enclosed housing. The only contact with the housing is the springs and, accordingly, vibration of the pump is absorbed by the springs of very low natural frequency and not transmitted to the pipe 30 or the fuel tank per se. The flexible tube 50 isolates the pump so that vibration is not transmitted to the flange 22. In addition, the shrouding of the pump housing 40 by the outer housings 60, 62 with the spacing of the walls and the inturned flange provides a noise barrier.

As shown in FIG. 1, a filter pad or envelope 90 is flexibly connected to and supported by the pump inlet 42. This filter will maintain contact with the bottom of the tank during axial displacement of the pump riding in the springs 80, 82. In addition, the flexible relationship of the filter pad adjusts to production dimensional variations and assures fuel pick-up as the tank expands or contracts with temperature and pressure variations.

What is claimed is:

1. In a fuel system for passenger vehicles wherein an electric fuel pump is utilized to move fuel from a fuel tank to a fuel distribution device at an internal combustion engine and having a pressure regulator valve to direct excess fuel back to the fuel tank, an improvement to reduce noise emission and vibration which comprises:

(a) a fuel pump having a generally cylindrical casing with side walls and end walls, (b) an open-ended enclosure surrounding said pump having walls spaced from the side walls and the end walls of said pump casing to allow the flow of fuel around said pump casing, (c) means to suspend said enclosure in a fuel tank, and (d) resilient coil springs at each end of said pump casing bearing at one end respectively against an end wall of said pump casing and bearing at the other end against the interior of said enclosure to resiliently isolate and float said pump within said enclosure.

2. A structure as defined in claim 1 which said means to suspend said enclosure comprises a functional pipe depending within said tank and said enclosure is cylindrical in shape and formed of a molded plastic and comprises two end portions axially joined with aligned integral side extensions on each portion recessed to receive said pipe, and means to clamp said pipe within said recessed portions and to rigidly join said two portions in close axial relation.

3. A structure as defined in claim 1 in which said enclosure has inwardly extending flanges at each end providing end openings in said enclosure and said pump has annular shoulders at each end, and said coil sporings at each end bear respectively against said flanges and said shoulders.

4. A structure as defined in claim 1 in which said means to suspend the enclosure comprises a functional pipe depending within said tank, and said enclosure is formed of a molded plastic and said means to mounted said enclosure comprises a side extension molded integrally with said enclosure having a groove to receive said return pipe, and a clamp plate to secure said pipe in said groove.

5. In a fuel system for passenger vehicles wherein an electric fuel pump is utilized to move fuel from a fuel tank to a fuel distribution device at an internal combustion engine and having a pressure regulator valve to direct excess fuel back to the fuel tank, an improvement to reduce noise emission and vibration which comprises:

(a) a fuel pump having a generally cylindrical casing with side walls and end walls, (b) an open-ended enclosure surrounding said pump having walls spaced from the side walls and the end walls of said pump casing to allow the flow of fuel within the enclosure and around said pump casing, (c) means to suspend said enclosure in a fuel tank comprising a depending shaft resiliently mounted in the top of the tank, and (d) tapered resilient coil springs at each end of said pump casing, each bearing at one end respectively against an inturned end flange of said enclosure and bearing at the other end against an end wall from said pump casing, each said coil spring having coils tapering from one diameter at the pump casing to enlarging coils at said enclosure, said coils being also spaced radially and axially to allow fluid flow through the coils and to resiliently isolate and float said pump casing to absorb radial, axial, and torque vibrations of said pump.

* * * * *